United States Patent [19]

Musschoot

[11] 3,989,227

[45] Nov. 2, 1976

[54] FLUID BED BLENDER AND COOLER

[75] Inventor: Albert Musschoot, Barrington, Ill.

[73] Assignee: General Kinematics Corporation, Barrington, Ill.

[22] Filed: Oct. 10, 1974

[21] Appl. No.: 513,931

[52] U.S. Cl. ..... 259/2; 259/72; 198/755; 198/766

[51] Int. Cl.[2] ..... B01F 11/00; B01F 13/02

[58] Field of Search ..... 259/2, 72, 173, 147, 259/151; 198/220 R, 220 A, 220 BA, 220 CA, 220 CB

[56] References Cited

UNITED STATES PATENTS

| | | | |
|---|---|---|---|
| 2,498,405 | 2/1950 | Fader | 259/2 |
| 3,297,304 | 1/1967 | Wahl | 259/2 |
| 3,558,105 | 1/1971 | Moritz | 259/72 |
| 3,576,313 | 4/1971 | Derderian | 259/72 |

*Primary Examiner*—Robert W. Jenkins

*Attorney, Agent, or Firm*—Wegner, Stellman, McCord, Wiles & Wood

[57] ABSTRACT

A vibratory fluid bed blender and cooler wherein material such as sand is both blended and cooled by being conveyed by vibratory movement along a bed provided with means for introducing fluid, such as air, in the bottom of the bed to pass through the material thereon and wherein the bed is provided with means for mixing the material thereon to blend it thoroughly.

5 Claims, 3 Drawing Figures

17
16
11
13
50
15
12
14
47
46
43
49
44
48
19
18
28
27
29
20
20
33
36
22
30
21
23
35
34
34
31
32
35
32
37

FLUID BED BLENDER AND COOLER

BACKGROUND OF THE INVENTION

Vibrating heat exchangers are not new. In previous designs the material to be treated is conveyed by vibration on a pan or plate, which is provided with perforations to permit the passage of air from below the pan up through the material thereon to be collected in a hood above the material. The perforated pan or plate is designed to develop a high static resistance in the perforations, and in operation the material to be treated is agitated by vibration which, in combination with the resistance of the perforated plates, results in an action causing the air to pass around the particles developing what is known as a "fluidized bed."

The passage of air through the bed of material can be for cooling, heating, or other processing requirements. One of the more common applications of the vibrating heat exchangers of the prior art is in the cooling of foundry sand, in which case the air functions to evaporate the moisture content of the sand and simultaneously cools the material by the evaporative cooling effect.

It has been a requirement of the fluid bed cooling apparatus heretofore used that the material to be treated must be very well blended so that it is as homogenous as is possible. It has been common heretofore to pre-blend the material before introducing it to the fluid bed by treating the material in large rotating drums or mixers to blend the material and/or to uniformly distribute the moisture therein. Such pre-blending was a definite requirement of the previous apparatus, and maximum efficiency of the fluid bed cooler could be attained only with such pre-blended homogenized material.

SUMMARY OF THE INVENTION

The apparatus of the present invention combines in a single unit not only a fluid bed cooler of unique design, but also a fluid bed cooler which by its construction and operation eliminates the necessity for pre-blending the material to be treated. Thus, the apparatus of the present invention serves not only to cool the material being treated and to eliminate moisture therefrom (if the material be, for example, foundry sand) but, in addition, serves to achieve a homogenous blend of the material while it is undergoing the fluidizing in the bed. By use of the present design, pre-blending drums are not needed nor are mixers or other apparatus for obtaining blending required to be used, in many of which moisture control problems as well as dust control problems existed.

A further feature of the present invention is a unique mounting for the fluid bed which includes a balancer operated in synchronism with the bed but oppositely thereto, with the arrangement being such that the springs supporting the bed and the springs supporting the balancer have axes which are coincidental so that forces developed by the trough springs are transmitted directly in line with the forces transmitted by the balancer springs thereby eliminating bending and other stresses on the overall apparatus.

DESCRIPTION OF THE PREFERRED EMBODIMENT

Figure 1:
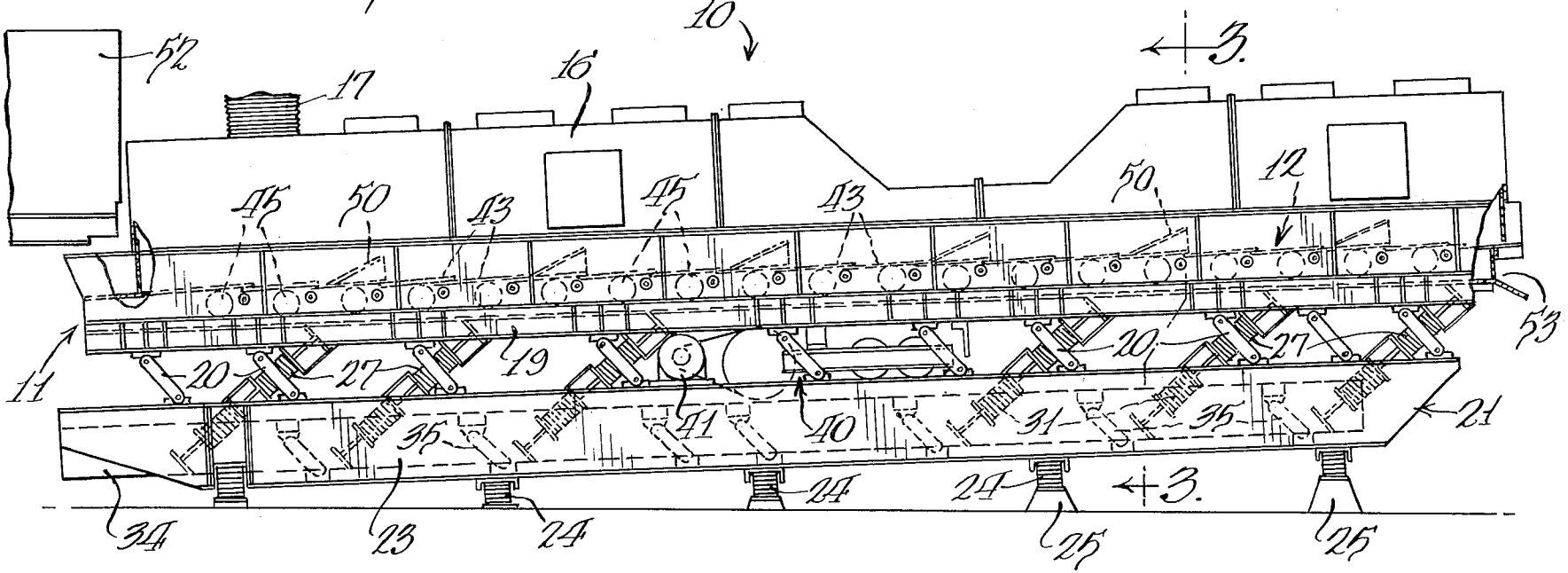
FIG. 1 is a side elevation showing a fluid bed blender and cooler of the present invention.

Referring now to the drawings, the fluid bed blender and cooler 10 includes a material-carrying member 11 in the form of a trough 12 having sides 13 and 14 extending vertically therefrom and a bottom 15. A hood 16 is carried by and covers the material-carrying member, which hood is provided with a plurality of exhausts 17 to remove moisture laden air.

Secured to the trough 12 is a pair of side beams 18 and 19 which support the material-carrying member. A first plurality of arms 20 are pivotally connected at one end to the side beams 18 and 19 and are pivotally connected at their other ends to the base member 21. The base member 21 includes a pair of parallel I-beams 22 and 23. The base member 21 is supported on a plurality of isolation springs 24 which in turn are supported by foundations 25 secured to the building or other solid foundation.

The material-carrying member 11 is supported for vibratory conveying movement by the arms 20 previously described and by a plurality of springs 27 whose axes lie generally parallel to the line of vibratory movement of the material-carrying member as dictated by the arms 20. The springs 27 bear at their upper ends against plates 28 secured to and extending transversely across the underside of the material-carrying member 11. The opposite ends of the springs 27 bear against plates 29 secured to the base member 21. A second plurality of plates 30 are secured to the base member 21 against which each one of a second plurality of springs 31 bears. The lower ends of the second plurality of springs 31 bear against transversely extending plates 32 secured to a balancing member 33. The balancing member 33 is in the form of a pair of longitudinally extending members 34 positioned on either side of the apparatus and extending parallel to the material-carrying member. A plurality of arms 35 are pivotally connected at one end to cross bars 36 extending between and connected to the longitudinally extending members 34, with the other end of the arms being pivotally connected to cross beams 37 secured to and extending between the I-beams 22 and 23 forming the base member 21.

Means generally designated 40 are provided for imparting synchronous and opposite vibratory movement to the material-carrying member and balancing member, which means include an electric motor 41 connected to drive a shaft carrying eccentric weights. The particular form of the vibration imparting system is not a part of the present invention and thus such vibrating means will not be further described herein. An example of such vibrating means is shown in my U.S. Pat. No. 3,750,866.

From the apparatus as so far described, it wll be understood that as the material-carrying member 11 is vibrated by the vibrating means 40, the first plurality of springs 27 are successively compressed and extended as are the second plurality of springs 31. The axes of the springs 27 and 31 are on a common line so that as compressive forces are applied to the base member 21 through the plates 29 and 30, the forces are opposite and in line and thus the compressive force of the springs 31 operates directly against the compression exerted by the springs 27. As the axes of the springs are in line, there is no bending force imparted to the base member 21.

Figure 2:
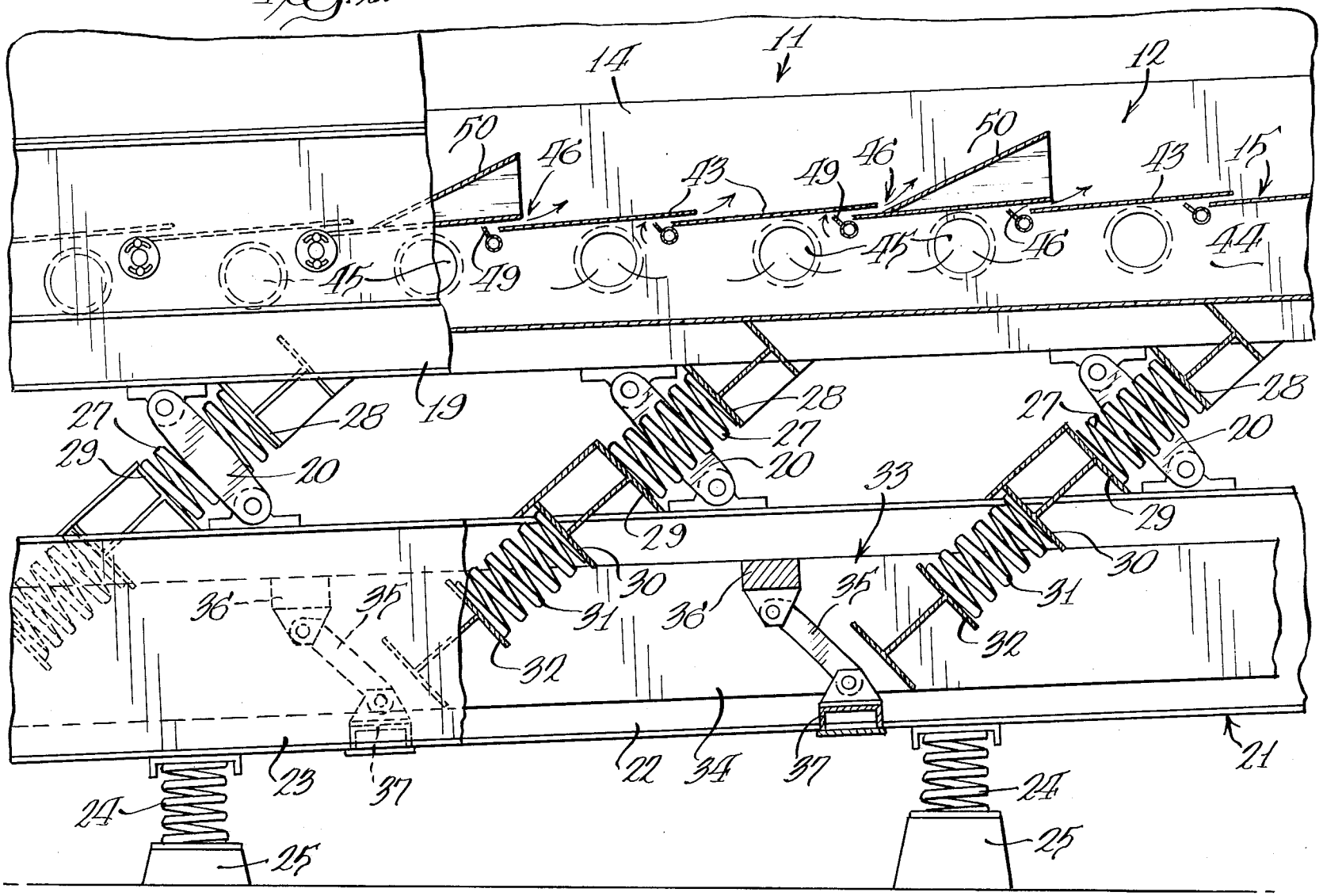
FIG. 2 is an enlarged view partially broken away of a portion of the apparatus shown in FIG. 1.

The bottom 15 of the material-carrying member 11 is made up of a plurality of spaced overlapping plates 43. A plenum chamber 44 lies below the plates 43 to which chamber is delivered a supply of air under pressure through intake ports 45. Air flowing into the plenum chamber 44 flows upwardly through the spaces 46 at the area of overlap of the plates 43 as shown by the arrows in FIG. 2. Air passing through the spaces 46 may pass upwardly through the material carried on the bottom 15 and thence into the hood area 16 and out the exhausts 17.

Air is introduced into the inlet ports 45 by means of ducts 47, each of which is provided with a control vane 48 for controlling the flow of air into the plenum chamber. Located by each individual space 46 is a rotatable control vane 49 individually adjustable to control the flow of air from the plenum chamber 44 up through each space 46.

Figure 3:
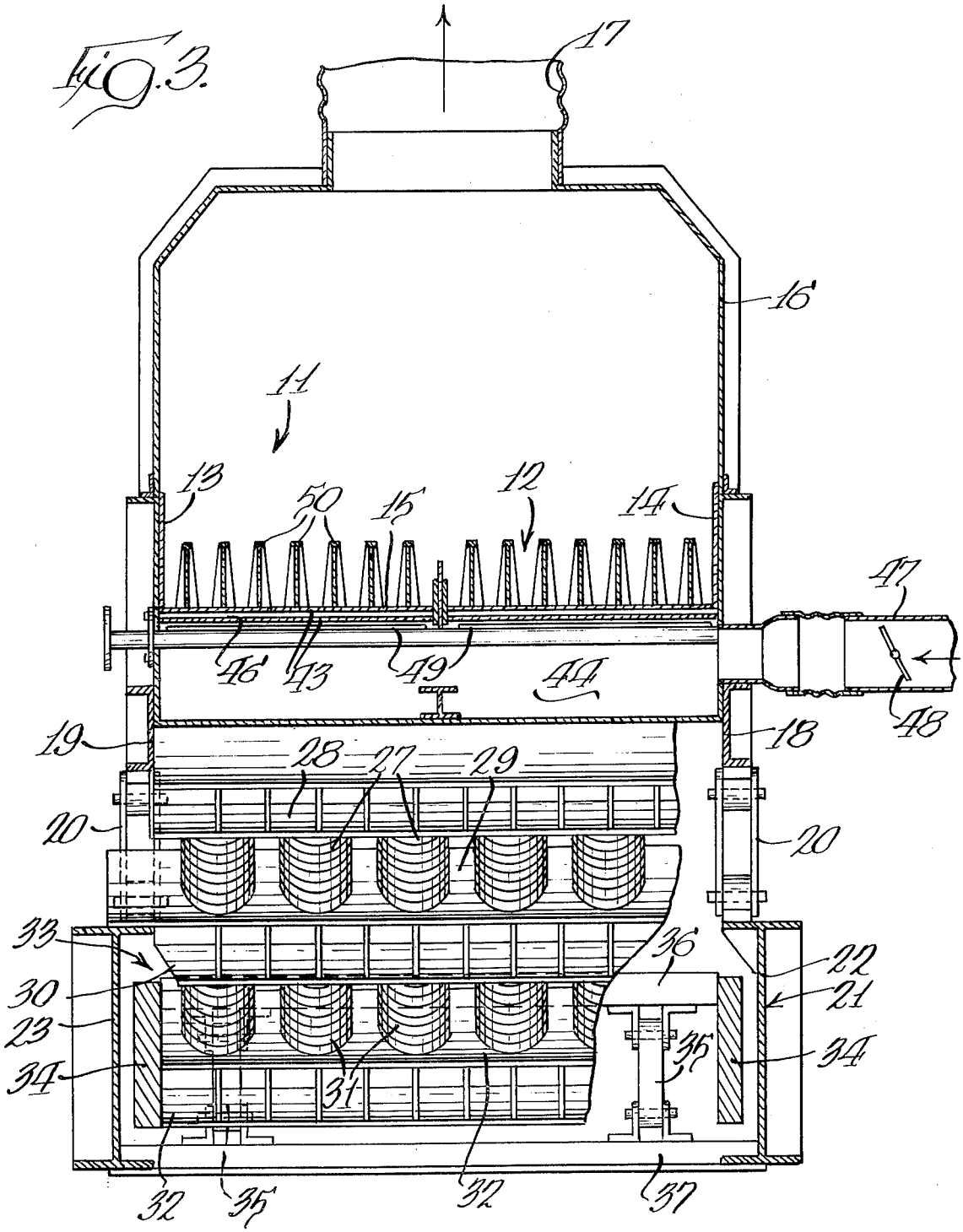
FIG. 3 is a vertical sectional view along line 3—3 of FIG. 1.

As previously indicated, means are carried by the material-carrying member 11 to insure proper blending of the material conveyed along the bottom 15. As shown in the drawings, particularly FIGS. 2 and 3, the blending means comprise a plurality of rows of spaced upwardly extending surfaces 50, with each surface tapering from a relatively wide area adjacent the bottom 15 to a narrow area at its upper extremity. Material may be introduced into the fluid bed blender and cooler through a hopper 52 and the material, after being treated, is discharged through an exit 53 at the opposite end of the apparatus.

Material such as hot moist foundry sand introduced into the hopper 52 flows onto the bottom 15 of the material-carrying member 11 and moves therealong from left to right (as shown in FIG. 1) under the conveying force of the vibrating apparatus. As the material travels, it climbs the inclined surfaces 50 and as such surfaces are tapered, a portion of the sand falls off in the process. The movement of the material imparted by the vibrating action of the trough is generally in a straight line and as it climbs the tapered fingers 50, it finally reaches a point on the taper where it falls back to the bottom 15. As a number of rows of such inclined surfaces or fingers are provided, a very efficient and active blending of the material occurs through the action just described. Air introduced into the plenum chamber flows through the spaces 46 between the overlapping plates to provide a cooling effect as well as a drying effect on the sand. By adjustment of the vanes 48 and 49, the flow of air at each particular point along the bed of the material-carrying member may be controlled to achieve the cooling and drying action.

I claim:

1. A fluid bed blender comprising a horizontally arranged, longitudinally extending, material-carrying member having a bottom for supporting pulverulent material thereon, said bottom including a plurality of overlapping plates spaced apart at the area of overlap, means supporting the material-carrying member for vibratory conveying motion, a plenum chamber carried by the material-carrying member below the bottom thereof, means for introducing fluid into the plenum chamber for passage upwardly through the spaces separating the overlapping plates to provide a flow of fluid through the material carried by said bottom and to aid in moving said material horizontally along said member, means carried by the member providing a blending of material being carried on the bottom thereof, and means for imparting vibratory conveying movement to said material-carrying member.

2. A fluid bed blender comprising a material-carrying member having a bottom for supporting pulverulent material thereon, said bottom including a plurality of overlapping plates spaced apart at the area of overlap, means supporting the material-carrying member for vibratory conveying motion, a plenum chamber carried by the material-carrying member below the bottom thereof, means for introducing fluid into the plenum chamber for passage upwardly through the spaces separating the overlapping plates to provide a flow of fluid through the material carried by said bottom, a plurality of adjustable vanes in said plenum chamber for controlling the flow of fluid through said spaces, means carried by the member providing a blending of material being carried on the bottom thereof, and means for imparting vibratory conveying movement to said material-carrying member.

3. A fluid bed blender comprising a horizontally arranged, longitudinally extending, substantially unitary material-carrying member having a bottom for supporting pulverulent material thereon, means supporting the material-carrying member for vibratory conveying motion, means associated with the bottom of the material-carrying member for providing a flow of fluid through material thereon in the direction of conveying motion, a row of spaced upwardly inclining surfaces on said bottom up which material is vibratorily conveyed and from which material so conveyed falls back to the bottom, and means for imparting vibratory conveying movement to said material-carrying member.

4. A fluid bed blender comprising a horizontally arranged, longitudinally extending, substantially unitary material-carrying member having a bottom for supporting pulverulent material thereon, means supporting the material-carrying member for vibratory conveying motion, means associated with the bottom of the material-carrying member for providing a flow of fluid through material thereon in the direction of conveying motion, a plurality of rows of spaced upwardly inclining surfaces of diminishing area on said bottom to provide surfaces up which material is vibratorily conveyed and from which material so conveyed falls back to the bottom, and means for imparting vibratory conveying movement to said material-carrying member.

5. A fluid bed blender comprising a horizontally arranged, longitudinally extending, substantially unitary material-carrying member having a bottom for supporting pulverulent material thereon, said bottom including a plurality of overlapping plates spaced apart at the area of overlap, means supporting the material-carrying member for vibratory conveying motion, a plenum chamber carried by the material-carrying member below the bottom thereof, means for introducing fluid into the plenum chamber for passage upwardly through the spaces separating the overlapping plates to provide a flow of fluid through the material carried by said bottom in the direction of conveying motion, a plurality of rows of spaced upwardly inclining surfaces of diminishing area on said bottom to provide surfaces up which material is vibratorily conveyed and from which material so conveyed falls back to the bottom, and means for imparting vibratory conveying movement to said material-carrying member.

* * * * *